United States Patent [19]

Bar

[11] 4,392,789

[45] Jul. 12, 1983

[54] HERMETICALLY SEALED MOTOR-COMPRESSOR UNIT FOR REFRIGERATORS

[75] Inventor: Alfredo Bar, Pavia, Italy

[73] Assignee: Necchi Societa per Azioni, Pavia, Italy

[21] Appl. No.: 214,766

[22] Filed: Dec. 9, 1980

[30] Foreign Application Priority Data

Feb. 20, 1980 [IT] Italy ..... 42904 A/80

[51] Int. Cl.[3] ..... F04B 39/06

[52] U.S. Cl. ..... 417/312; 62/296; 417/424; 417/902

[58] Field of Search ..... 417/902, 312, 313, 363, 417/372, 366, 424; 62/296; 181/403

[56] References Cited

U.S. PATENT DOCUMENTS

| | | | |
|---|---|---|---|
| 3,044,688 | 7/1962 | Frank et al. | 417/312 |
| 3,385,515 | 5/1968 | Parker | 417/312 |
| 3,486,687 | 12/1969 | Ayling | 417/312 |
| 3,857,652 | 12/1974 | Thayer | 417/902 X |

*Primary Examiner*—Edward K. Look

*Attorney, Agent, or Firm*—Stevens, Davis, Miller & Mosher

[57] ABSTRACT

A hermetically sealed motor-compressor unit for refrigerators, of vertical axis, comprising a container for said motor compressor unit defining a sump for the gravitational collection of oil therein and a motor compressor unit positioned within said container, said compressor unit comprising a casing defining a plate, a cylinder, silencer portions positioned at the end of said cylinder below said plate, upper support means extending upwardly from said plate, perimetral walls extending upwardly along a portion of the plate and lower support means extending downwardly from the plate supporting said motor compressor in said container; an electric motor supported on said upper support means; spherical caps fastened to said silencer portions to form silencers; a cylinder head defining a suction chamber and delivery chamber interconnected to said silencers; a vertical shaft and a lubricating member disposed on the lower end of said shaft and immersed in said sump.

3 Claims, 4 Drawing Figures

HERMETICALLY SEALED MOTOR-COMPRESSOR UNIT FOR REFRIGERATORS

This invention relates to a hermet-ically sealed motor-compressor unit for refrigerators, of vertical axis, comprising a compressor casing, the casting of which incorporates the cylinder, silencer portions, upper support means for supporting the electric motor and lower support means for suspending said motor-compressor unit inside its container, a cylinder head, spherical caps fixed to said silencer portions to form therewith the silencers which communicate with the suction and delivery chambers provided in said head, and a lubrication member disposed at the lower end of the compressor shaft and immersed in the lubricating oil sump disposed in said container. The object of the invention is to substantially reduce the noise of the oil which falls back into the sump after lubricating the couplings of the motor-compressor unit, or after it has been propelled against the lower part of the compressor casing by the lubrication member and the means with which it is provided for agitating the oil.

The technical problem to be solved in order to attain the aforesaid object is to convey the lubricating oil to the sump along certain surfaces of the motor-compressor unit which are immersed in the oil in order to prevent the oil dripping from the elevated parts of the motor-compressor unit directly into said sump.

A supplementary effect is obtained by compelling the lubricant to graze high temperature surfaces along its return path to the oil sump.

The solution to the aforesaid technical problem is characterised in that said casing comprises, on its upper portion, walls which run along a perimetral part thereof and which rise to a greater height than that of the remaining perimetral part, so as to compel the lubricating oil collected on said upper portion to flow along said remaining perimetral part.

Further advantages and characteristics will be apparent from the description of a preferred embodiment of the invention and from the accompanying drawings in which.

Figure 1:
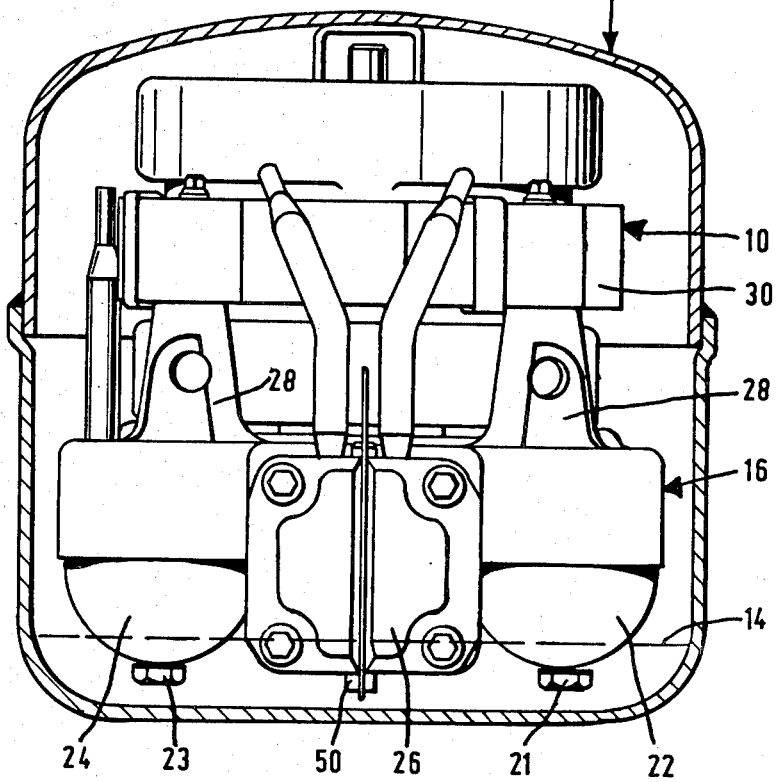
FIG. 1 is a complete view of the motor-compressor unit.

FIG. 1 shows a motor-compressor unit 10 hermetically sealed in a container 12, on the base of which a lubricating oil sump 14 is provided.

The motor-compressor unit 10 comprises a casing 16 in which, in known manner, the cylinder 17 (FIG. 2) is formed together with two portions 18 and 20 which with the spherical caps 22 and 24, which are fixed to the casing 16 by screws 23, form the silencers connected respectively to the suction chamber and delivery chamber provided in the head 26 of the cylinder 17.

Figure 3:
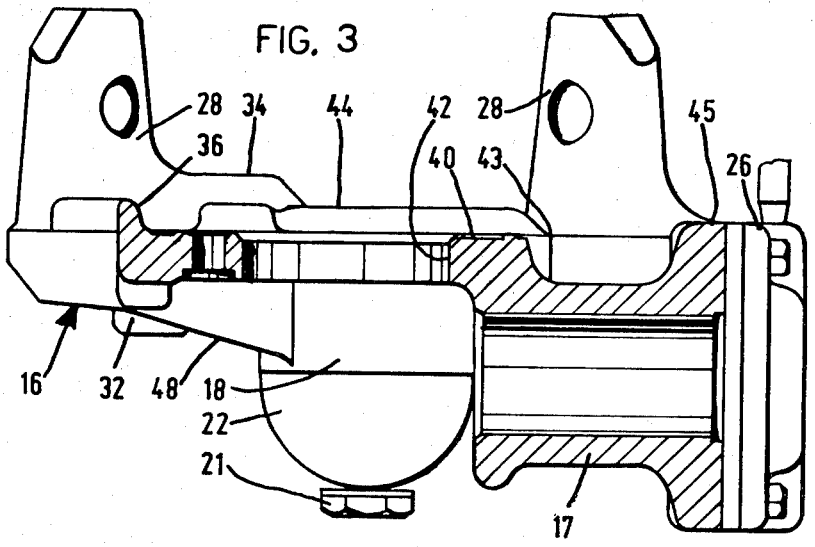
FIG. 3 is a section through the compressor casing on the line 3—3 of FIG. 2.
Figure 4:
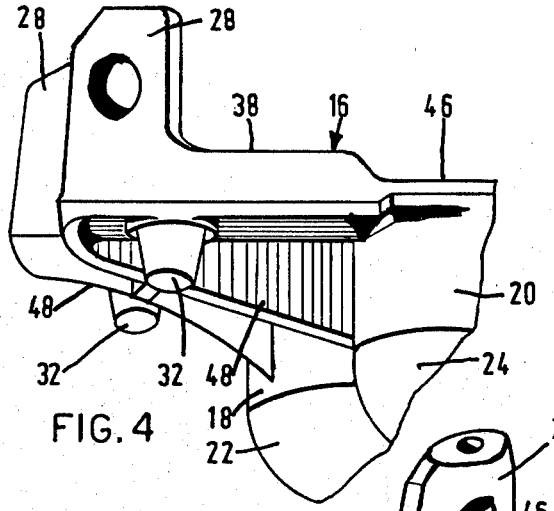
FIG. 4 is a perspective view of a portion of the lower part of the compressor casing.
Figure 2:
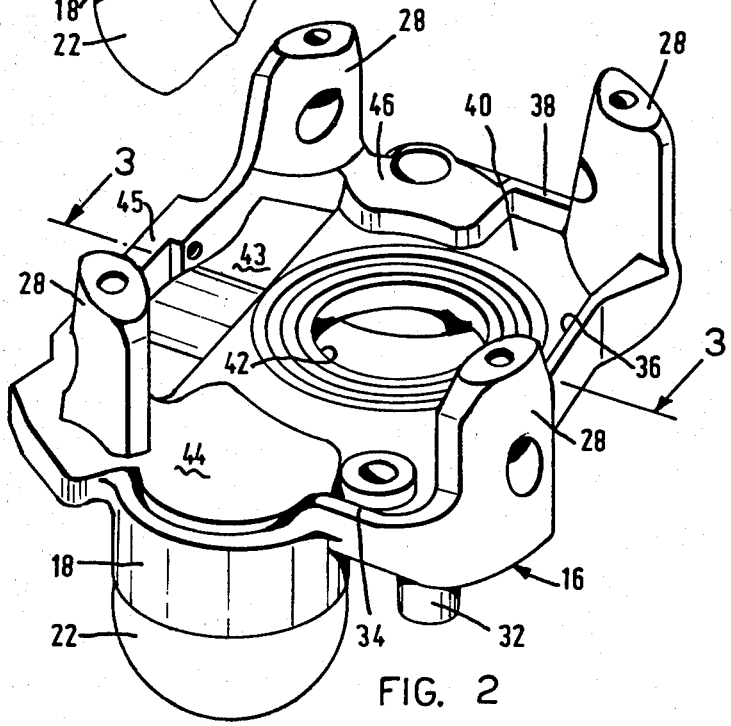
FIG. 2 is a perspective view of the upper part of the compressor casing.

With reference to FIGS. 1, 2 and 3, the casing 16 of the motor-compressor unit 10 comprises four supports 28 on which the electric motor, or more specifically the stator 30, is fixed.

On its lower part, the casing 16 comprises four supports 32 which serve for suspending the motor-compressor unit from the container 12 in known manner.

According to the idea of the invention (FIG. 3), the casing 16 comprises on its upper part walls 34, 36 and 38 which rise from the plate portion 40 which is provided with the bore 42 for passage of the shaft (not shown in the figures) of the motor-compressor unit 10.

The oil which has lubricated the bush-shaft coupling of the compressor and collectors on the plate portion 40 and in the cavities 43 of the casing 16 is compelled by this to return to the sump 14 by passing across the zone 45 an descending along the outer surface of the cylinder 17, of the valve plate and of the head 26, so aiding the removal from these parts of the heat produced during the compression of the refrigerant gas.

A part of the oil can also descend into the sump by grazing the portions 44 and 46, which are lower than the walls 34, 36, 38, and the spherical caps 22 and 24 which are also immersed in the sump 14.

On the opposite side of the cylinder, the lower portion of the casing comprises two ribs 48 along which any oil which has been propelled against the lower part of the casing 16 by the lubrication member 50 fixed to the compressor shaft is conveyed on to the surfaces of the two silencers 22, 24 which are partly immersed in the sump 14.

Any dripping of the lubricating oil from the member portions directly into the sump 14, and consequently the noise deriving from said dripping are thus prevented. An additional effect is the cooling of the cylinder head 26 by the oil which returns to the sump 14 from the upper surface of the casing 16 by grazing the outer surfaces of the cylinder 17, the valve plate and the head 26.

I claim:

1. A hermetically sealed motor-compressor unit for refrigerators, of vertical axis, comprising a container for said motor compressor unit defining a sump for the gravitational collection of oil therein and a motor compressor unit positioned within said container, said compressor unit comprising a casing defining a plate, a cylinder, silencer portions positioned at the end of said cylinder below said plate, upper support means extending upwardly from said plate, perimetral walls extending upwardly along a portion of the plate and lower support means extending downwardly from the plate supporting said motor compressor in said container; an electric motor supported on said upper support means; spherical caps fastened to said silencer portions to form silencers; a cylinder head defining a suction chamber and delivery chamber interconnected to said silencers; a vertical shaft and a lubricating member disposed on the lower end of said shaft and immersed in said sump.

2. A motor-compressor unit as claimed in claim 1, including a perimetral portion without walls, said perimetral portion without walls being connected to the cylinder head and to the silencers, all these elements being partly submrged in said lubricating oil sump, so that said lubricant flows towards the sump by grazing the outer surfaces of said silencers and of said head, to remove from this latter, from the cylinder the heat accumulated in said elements.

3. A motor-compressor unit as claimed in claim 1, including two inclined ribs provided on the casing and connected to said silencers, and along which any oil propelled against the lower part of the casing by the rotating lubrication member is conveyed on to the outer surfaces of said silencers, said silencers being immersed partly in said oil sump.

* * * * *